United States Patent [19]

Caccavale

[11] 4,213,537

[45] Jul. 22, 1980

[54] CONTAINER LID ASSEMBLY

[75] Inventor: Patrick W. Caccavale, Kensington, Conn.

[73] Assignee: Sherri Cup, Inc., Kensington, Conn.

[21] Appl. No.: 943,987

[22] Filed: Sep. 20, 1978

[51] Int. Cl.[2] ..... B65D 51/16; B65D 41/18; B65D 41/62

[52] U.S. Cl. ..... 220/215; 220/374; 229/43

[58] Field of Search ..... 220/215, 373, 374, 23; 229/43

[56] References Cited

U.S. PATENT DOCUMENTS

| | | | |
|---|---|---|---|
| 933,103 | 9/1909 | Norton | 220/373 |
| 2,563,352 | 8/1951 | Morse | 220/215 |
| 2,604,976 | 7/1952 | Sarg | 220/23 |
| 2,915,404 | 12/1959 | Tessmer | 220/23 |
| 3,193,130 | 7/1965 | Miller | 220/374 |
| 3,459,324 | 8/1969 | Miller | 220/374 |
| 3,805,991 | 4/1974 | Cheladze | 220/373 |
| 4,018,355 | 4/1977 | Ando | 220/23 |

*Primary Examiner*—George E. Lowrance
*Attorney, Agent, or Firm*—McCormick, Paulding & Huber

[57] ABSTRACT

A cover assembly for a paper receptacle comprising a molded plastic lid and a paper insert secured within the lid. The lid and the insert cooperate to define an air space therebetween. A vent opening in the lid communicates with the air space and is out of registry with another vent opening through the insert which also communicates with the air space.

1 Claim, 4 Drawing Figures

CONTAINER LID ASSEMBLY

BACKGROUND OF THE INVENTION

This invention relates in general to disposable paper receptacles and deals more particularly with an improved insulating cover assembly for a disposable container of a type particularly suited to package hot food sold by fast food restaurants and the like. Advances in the plastic molding art have made it feasible to produce, at low cost, unitary molded plastic lids for disposable paper containers. In addition to the obvious cost advantage, such a lid may be readily produced with an integral design impressed therein, as, for example, a trademark. While such a molded container lid may be suitable for many uses it generally lacks the insulating quality inherent in a container cover made from heavy paper. It is the general aim of the present invention to provide an improved low cost container cover assembly suitable for use in packaging hot food and which has insulating qualities comparable to those of substantially more expensive formed paper container covers.

SUMMARY OF THE INVENTION

In accordance with the present invention, a cover assembly for a paper receptacle includes a lid, an insert, and means for retaining the insert in assembly with the lid with a portion of the outer surface of the insert engaging an associated portion of the inner surface of the lid so that the lid and the insert cooperate to define an air chamber therebetween. Means is provided for releasably securing the cover assembly to a paper receptacle.

DETAILED DESCRIPTION OF PREFERRED EMBODIMENT

Figure 1:
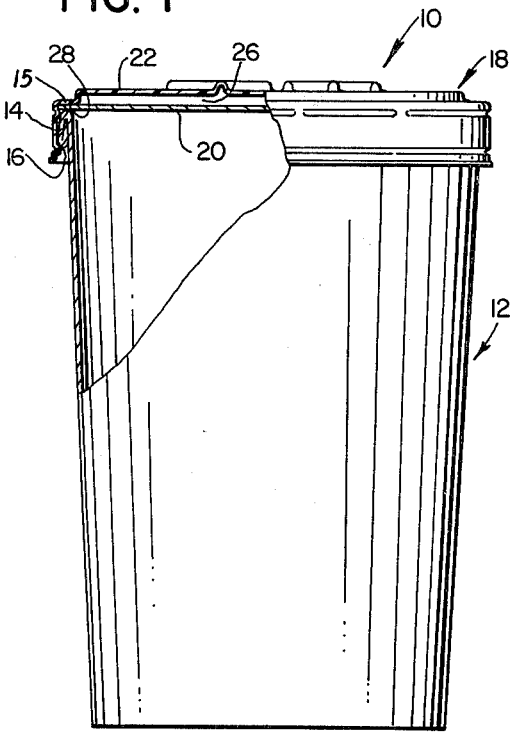
FIG. 1 is a fragmentary side elevational view of a paper receptacle which has a cover assembly embodying the present invention.

Referring now to the drawing, a cover assembly embodying the present invention and indicated generally by the reference numeral 10 is shown in FIG. 1 positioned on a conventional formed receptacle or container indicated generally at 12. The container 12 is preferably made from heavy paper, has a generally frustro-conical shape, and is particularly adapted for packaging hot food. A generally cylindrical cover retention member 14 is integrally connected to the upper end of the container body and may comprise a rolled over portion of the body. The cover retention member 14 has an upwardly facing seating surface 15 and a downwardly facing seating surface 16 defined by its lower edge surface, substantially as shown in FIG. 1.

Figure 2:
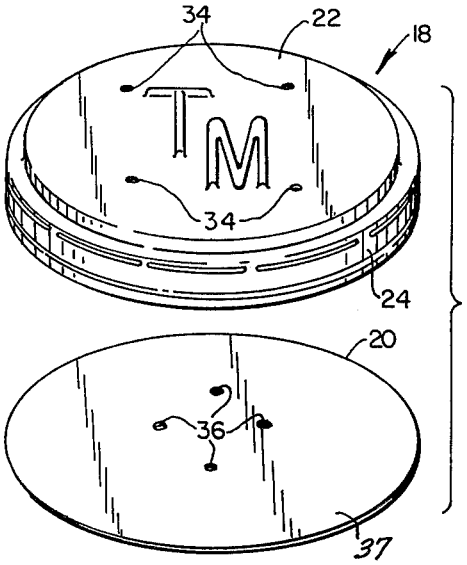
FIG. 2 is an exploded perspective view of the cover assembly shown in FIG. 1.
Figure 3:
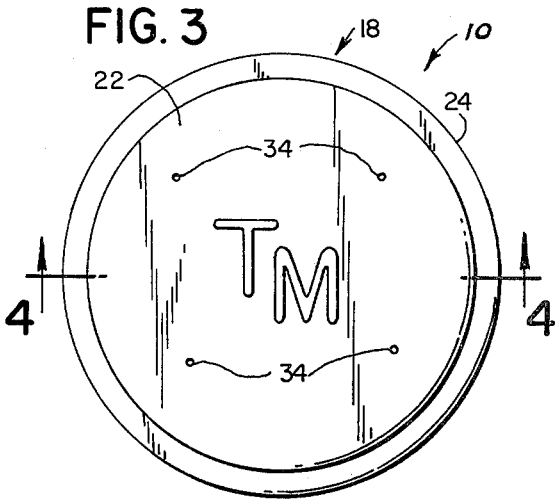
FIG. 3 is a plan view of the cover assembly of FIG. 1.
Figure 4:
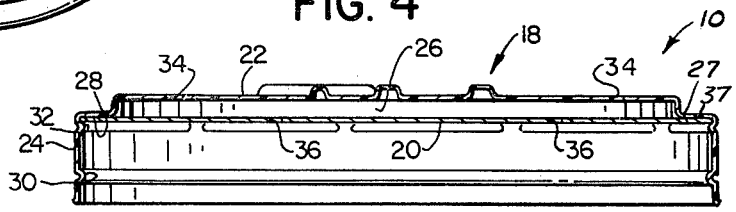
FIG. 4 is a sectional view taken along the line 4—4 of FIG. 3.

The cover assembly 10 includes a lid indicated generally at 18 and an insert 20, as best shown in FIG. 2. The lid 18 is preferably comprises a thin-walled shell of substantially uniform thickness preferably made from plastic or other suitable material which may be readily formed by a conventional molding process. Referring particularly to FIGS. 3 and 4, the illustrated lid 18 has a generally cylindrical configuration and includes a top or end wall 22 and an integral cylindrical side wall 24. The end wall 22 is formed with a recess 26 which opens downwardly through its inner surface. The end wall also has a radially disposed annular outer marginal portion 27 which defines the open end of the recess 26 and a radially disposed downwardly facing annular bearing surface, the latter surface being indicated by the numeral 28, and best shown in FIG. 4. If desired, a design, such as a trademark, indicated by the letters T.M. in FIG. 3, may be impressed into end wall, substantially as shown. The inside diameter of the cylindrical side wall 24 is approximately equal to the outside diameter of the lid retention member 14 upon which it is received. At least one bead 30 is formed on the side wall 24 and projects radially inwardly from the inner surface of the side wall. The bead 30 may comprise a continuous annular bead or, if desired, may be formed by a plurality of interrupted arcuate bead positions which project inwardly from the side wall 24. The bead 30 is located on the side wall 24 for snap engagement with the downwardly facing seating surface 16 when the cover assembly 10 is positioned on the container 12. At least one other bead 32 is formed on the side wall 24 to retain the insert 20. The latter bead projects radially inwardly from the inner surface of the side wall 24 in closely spaced relation to the inner surface 28 and may comprise a single continuous annular bead or, alternatively, may be formed by a plurality of angularly spaced bead sections.

At least one vent hole 34 opens through the end wall 22 and communicates with the recess 26 for a purpose which will be hereinafter further apparent. The number and arrangement of the vent holes may vary, however, the illustrated lid 18 is provided with four angularly spaced vent holes 34, 34, substantially as shown in FIG. 3.

The insert 20 comprises a circular paper disc which has a diameter substantially equal to the inside diameter of the cylindrical side wall 24 and an annular marginal portion 37. One or more vent holes, such as indicated at 36, 36 in FIG. 2, are formed in the insert 20. The insert is assembled in snap-in engagement within the lid 18 and is retained in assembly with the lid by cooperation of the bead 32 with the inwardly facing surface 28. In assembly, a portion of the outer surface of the insert 20 engages an associated portion of the inner surface 28. The lid 18 and the insert 20 cooperate to define a chamber or air space therebetween, which comprises the recess 26. In assembly, the vent holes 34 are out of registry or vertical alignment with the vent holes 36.

Alternately, the outside diameter of the circular paper insert 20 and the inside diameter of the cylindrical side wall 24 may be dimensioned so that the insert is received and retained in press fit assembly with the lid. When such an assembly arrangement is used, the bead 32 may be omitted from the lid 18.

The vent holes serve to vent air from the container 12 without risk of spillage. The air space 38 provides a desired degree of insulation which makes the illustrated container 12 and cover assembly 10 particularly suitable for use in packaging hot food.

I claim:

1. An insulated cover assembly for a paper receptacle having an upwardly facing annular seating surface at its open upper end, said cover assembly comprising a lid made from plastic material of substantially uniform thickness having a circular top wall including a generally cylindrical downwardly opening recess having a diameter substantially equal to the diameter of the open upper end of the receptacle and partially defining an empty chamber, said top wall having a raised design thereon further defining said chamber, said top wall having at least one vent opening therethrough and including a radially disposed annular outer marginal portion defining the open end of said recess and the outer peripheral edge of said top wall, said outer marginal portion having a radially disposed downwardly facing annular bearing surface, said lid having a generally cylindrical side wall integrally connected at its upper end to said outer peripheral edge and extending downwardly therefrom, said side wall having beads spaced downwardly from said outer marginal portion and projecting radially inwardly beyond the cylindrical inner surface of said side wall, a substantially flat circular insert received within said lid and having an annular marginal portion disposed in bearing engagement with said bearing surface, said insert cooperating with said lid to further define said chamber and having another vent opening therethrough out of registry with said one vent opening, one of said beads retaining said insert in snap-in assembly with said lid with said annular marginal portion in bearing engagement with said bearing surface, said annular marginal portion engaging the upwardly facing seating surface when said cover assembly is positioned on the receptacle, another of said beads releasably retaining said cover assembly in snap-on assembled relation to the receptacle.

* * * * *